United States Patent [19]

Beckley

[11] 4,006,910

[45] Feb. 8, 1977

[54] FOLDING SEAT

[76] Inventor: Charles R. Beckley, 2708 Woodley Place, Washington, D.C. 20008

[22] Filed: Sept. 16, 1975

[21] Appl. No.: 613,918

[52] U.S. Cl. ..... 297/16; 297/440; 297/441; 297/457

[51] Int. Cl.[2] ..... A47C 4/32

[58] Field of Search ..... 160/395; 297/16, 35, 297/38–41, 59, 441, 457; 403/61

[56] References Cited

UNITED STATES PATENTS

| | | | |
|---|---|---|---|
| 1,014,848 | 1/1912 | Reinert | 5/197 |
| 1,039,986 | 10/1912 | Merritt | 403/61 |
| 1,041,147 | 10/1912 | Murphy | 403/61 |
| 1,813,020 | 7/1931 | Brown | 5/196 X |
| 1,912,282 | 5/1933 | Krebs | 297/441 X |
| 3,399,926 | 9/1968 | Hehn | 297/457 |
| 3,578,385 | 5/1971 | Stiglitz | 297/440 |
| 3,856,345 | 12/1974 | Beckley | 297/16 |

*Primary Examiner*—James C. Mitchell
*Attorney, Agent, or Firm*—John Ridgley Moses

[57] ABSTRACT

A folding seat includes a pair of side frame members joined by detachable rungs. Each side frame member has an arm, a front leg and a back leg. One of the legs is pivoted directly to the arm, while the other leg is pivoted to the arm with a sliding link which locks with the arm when the seat is erected. A web is slung between the rungs to support a person sitting in the seat and is detachably held in place by rods which register with slots in the rungs.

16 Claims, 8 Drawing Figures

FOLDING SEAT

BACKGROUND OF THE INVENTION

1. Field of the Invention

This invention relates to seats and, more particularly, this invention relates to seats which fold from an erect position for seating a person to a collapsed position for storage and transport.

2. Technical Considerations and Prior Art

It is often desirable to have a chair, bench or the like, which folds from an erect configuration to a collapsed storage configuration. A commercially successful example of such a chair is the chair disclosed in the applicant's U.S. Pat. No. 3,856,345 of which the instant invention is an improvement.

With the chair disclosed in U.S. Pat. No. 3,856,345 it is necessary to extend bars between the front and rear legs in order to positively maintain the chair in its erect configuration. These bars must be stored when the chair is collapsed and therefore, result in slight inconvenience.

The chair disclosed in U.S. Pat. No. 3,856,345 utilizes a sling in order to provide a seat and back. In this patent, the sling is secured to the rungs of the chair by headed pins or screws which register with eyes in the fabric of the sling. Consequently, it is rather time consuming to detach the sling from the rungs.

With the chair disclosed in U.S. Pat. No. 3,856,345 it is often desirable to provide additional padding in the sling to avoid discomfort caused by the front and top rungs. This padding requires that pockets be provided in the sling and results in additional manufacturing expense.

OBJECTS OF THE INVENTION

In view of the afore-mentioned considerations, it is an object of the instant invention to provide a new and improved folding seat.

It is an additional object of the instant invention to provide a new and improved folding seat, wherein it is not necessary to provide locking bars to hold the seat in its erect condition.

It is still another object of the instant invention to provide a new and improved folding seat having a sling, wherein the sling is attached to rungs of the seat in a convenient manner.

It is a further object of the instant invention to provide a new and improved folding seat with increased comfort.

It is still an additional object of the instant invention to provide a folding seat which is an improvement over the seat disclosed in U.S. Pat. No. 3,856,345.

SUMMARY OF THE INVENTION

In view of these and other objects, the instant invention contemplates a folding seat having side frame members, each of which includes an arm, a front leg and a rear leg. The frame members are joined by front, back and top rungs, which support a sling extending therebetween.

One pair of legs are joined to the arms by fixed pivots so as to fold flush against the arms, while the other pair of legs have links projecting therefrom which are joined to the arms by sliding pivots. The links have a length which is slightly greater than the width of the legs mounted with the fixed pivots so that the legs, from which the links project, will fold thereover to form a compact folded seat.

According to the instant invention, the sliding pivots have a first position which allows the legs associated therewith to pivot, and a second position which prevents the legs associated therewith from pivoting. When the seat is in its erect condition, the pivots are in their second position, so that the legs will not pivot in relation to the arms.

Further, in accordance with the instant invention, the rungs have grooves therein which receive rods that are secured to the sling in order to secure the sling to the rungs.

DETAILED DESCRIPTION

Figure 1:
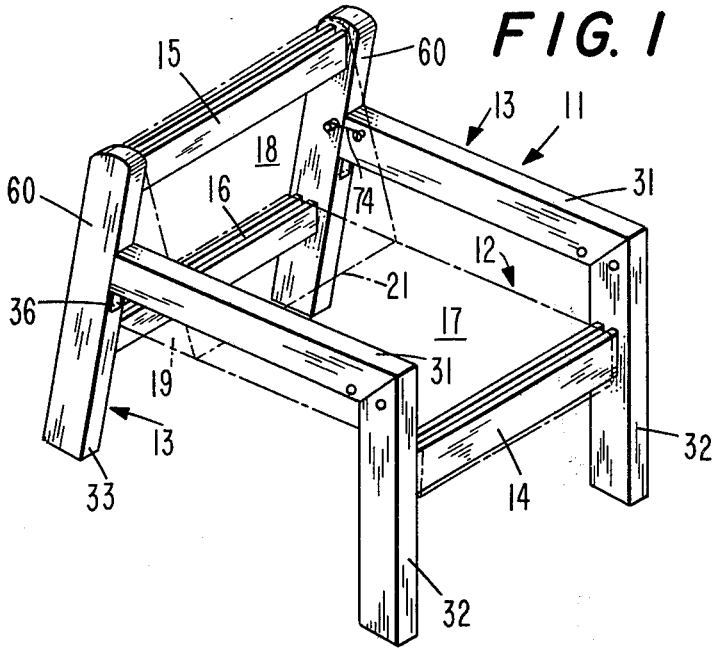
FIG. 1 is an isometric view of a chair, in accordance with the instant invention, shown in its erect condition.

Referring now to FIG. 1, there is shown a seat, designated generally by the numeral 11, which for purposes of illustration is in the form of a chair. It should be kept in mind that the seat 11 also could be in the form of other seating structures and arrangements, such as sofas, benches, or any other seating structure designed to accommodate one or more persons. The seat 11 includes a sling, designated generally by the numeral 12, which is supported between a pair of frame members, designated generally by the numerals 13—13. The sling 12 is made of a fabric, such as canvas, vinyl or the like, and serves to receive and support a person sitting in the seat. In order to support the sling 12 between the frames 13—13, the sling is secured to front top and rear cross rungs 14, 15 and 16, respectively, which extend between the frame members 13—13.

Figure 5:
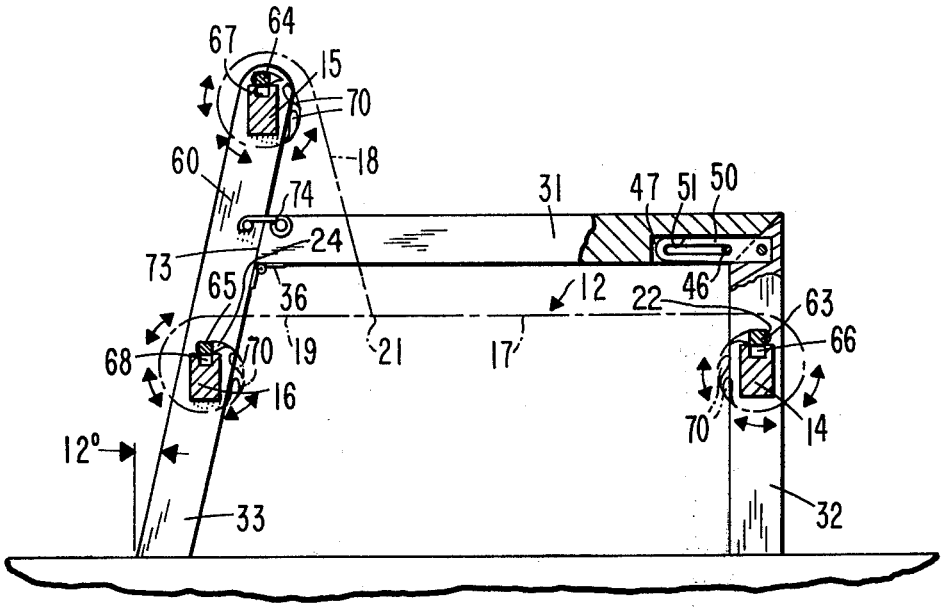
FIG. 5 is a side view of the chair of FIG. 1, while the chair is in its erect condition.

In the illustrated embodiment, the sling 12 is divided into a front segment 17, a back segment 18 and a rear segment 19. As best seen in FIG. 5, the front, back and rear segments 17, 18 and 19 radiate from a seam 21 with the front segment having its free end 22 attached to the front cross rung 14, the back segment having its free end 23 attached to the top cross rung 15, and the rear segment 19 having its free end 24 attached to the rear cross rung 16. The front segment 17 serves to support the buttocks and thighs of the person sitting in the seat 11, while the back segment 18 supports the back of the person sitting in the seat 11. In order to help define a comfortable seating contour, the rear segment 19, limits forward movement of the seam 21 by limiting the distance from the rear cross rung 16, so that the seam can move when a person sits in the seat 11. The specific structure for securing the web 12 on the rungs 14, 15 and 16 will be discussed in detail hereinafter.

Figure 2:
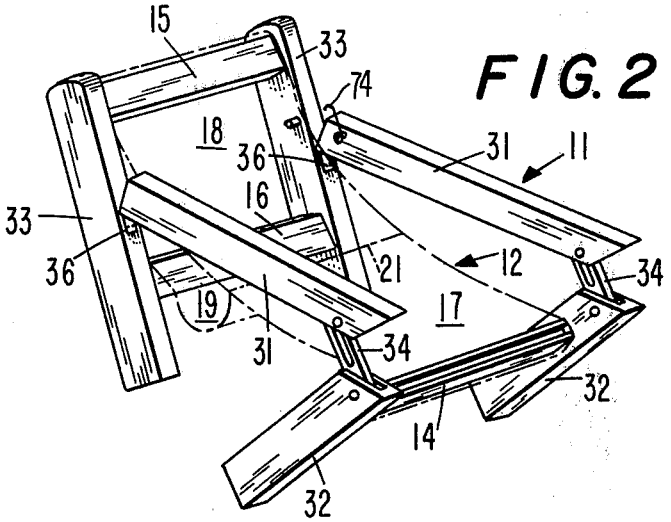
FIG. 2 is an isometric view of the chair shown in FIG. 1, being folded to its collapsed position.
Figure 3:
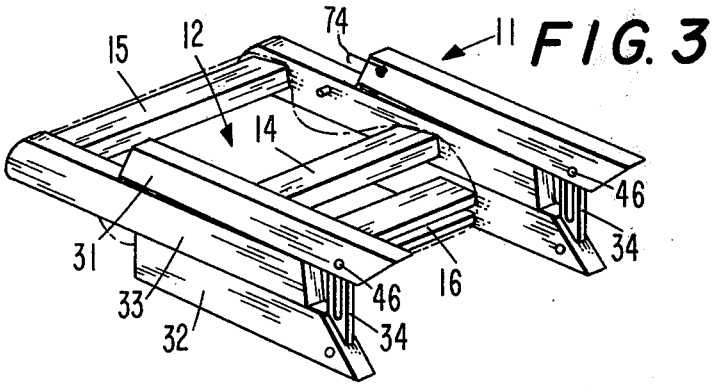
FIG. 3 is an isometric view of the chair of FIG. 1 shown completely collapsed for storage.

As seen in FIGS. 2 and 3, the seat 11 is collapsible from the erect condition shown in FIG. 1 to the collapsed folded condition shown in FIG. 3. This is accomplished by making the frame members 13—13 foldable.

As generally shown in the drawings, the frame members 13-13 each include an arm member 31, a front leg 32 and a rear leg 33. As seen in FIGS. 2 and 3, the front legs 32-32 are joined to the arm members 31-31 by links 34-34, while the rear legs 33-33 are joined to the arm members by hinges 36-36 which form fixed pivots.

Figure 6:
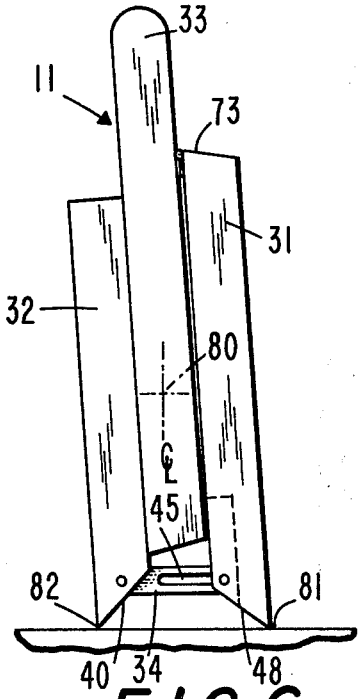
FIG. 6 is a side view of the chair of FIG. 3 shown standing vertically for storage.

In order to fold the chairs, the rear legs 33-33 are pivoted about the hinges 36-36 in order to extend flush against the arms 31-31. The front legs 32-32 are then pivoted over the rear legs 33-33, so as to overlie the rear legs, as shown in FIG. 3. This is accomplished by pivotally mounting the links 34-34 on pins 46-46. After the chair is folded to the collapsed configuration of FIG. 3, it may be stood on end as shown in FIG. 6.

Figure 4:
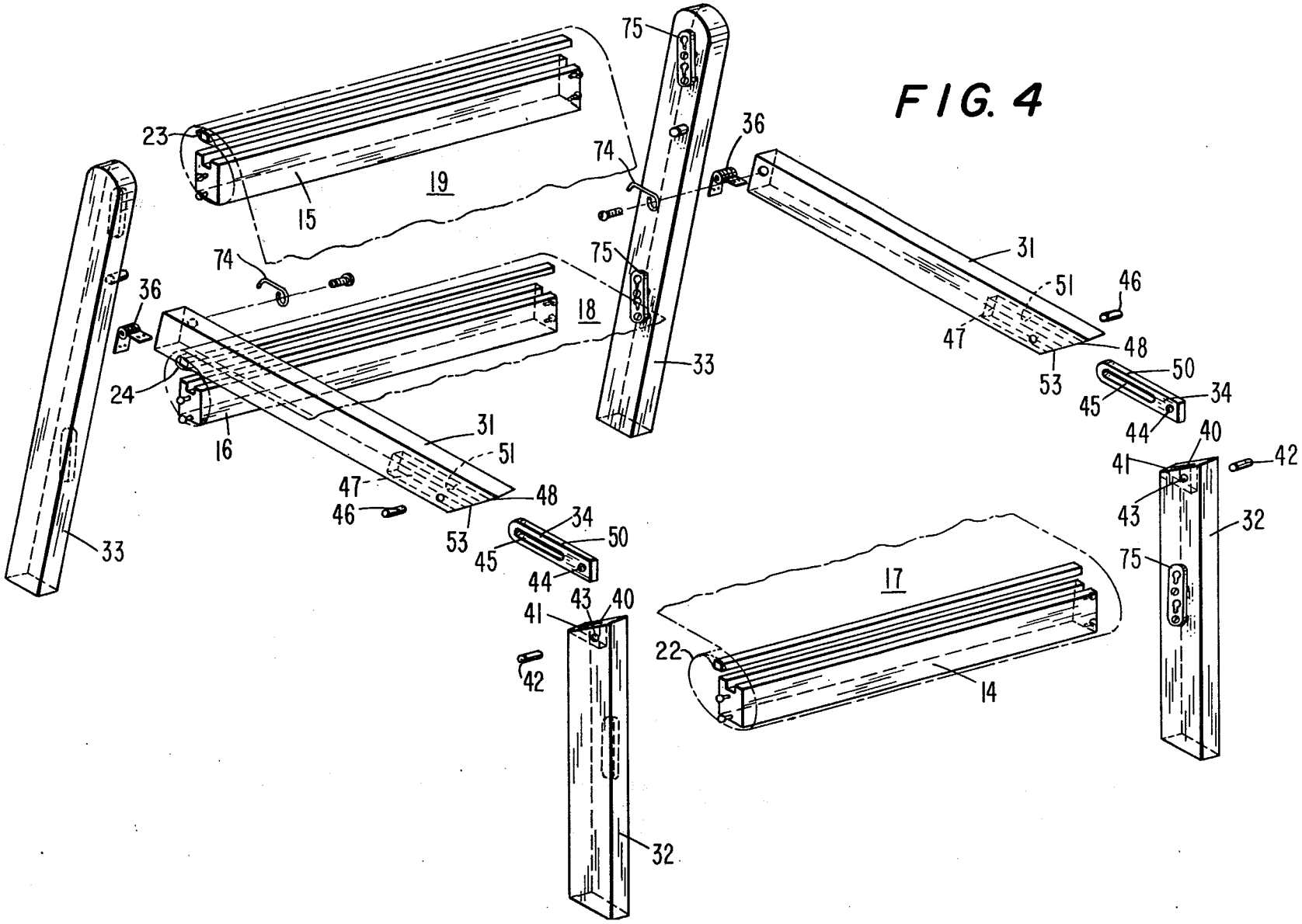
FIG. 4 is an exploded view of the chair of FIG. 1 showing its various component parts.

As is perhaps best known in FIG. 4, the links 34 are rigidly secured to the front legs 32-32 by inserting the links in slots 40 formed in the top ends 41 of the legs. The links 34 may be secured in the slots 40 by a suitable adhesive binder and pins 42 are preferably inserted through holes 43 and 44 in the legs and links, respectively, in order to form a firm mechanical connection. In the illustrated embodiment, the links 34 project normally to the extent of the legs 32.

Each link 34 has a slot 45 extending therein, which receives a pin 46 inserted into the associated arm 31. The pins 46 are positioned in slots 47 extending back from the ends 48 of the arms. The links 34 are received in the slots 47, while the pins 46 register with the slots 45 extending in the links to form sliding pivots.

Figure 8:
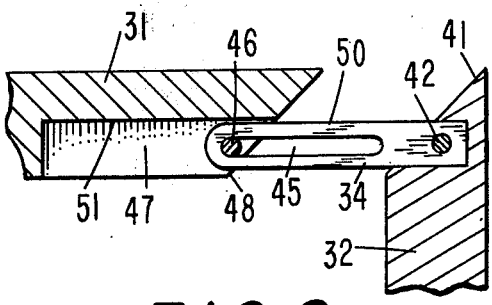
FIG. 8 is a side view partially in section showing how a front leg of the chair of FIG. 1 is pivotally secured to an arm of the seat.

As best seen in FIGS. 5 and 8, each link 34 has two positions. In the first position shown in FIG. 8, the link 34 is able to pivot about the pin 46, whereas in the second position shown in FIG. 5, the link 34 is not able to pivot about the pin 46. As seen in FIG. 5, the link 34 extends back into the slot 47, so that the top surface 50 of the link engages the top surface 51 of the slot 47. This engagement blocks the rotation of the legs 32, so that they remain fixed relative to the arms 31, thereby rigidly holding the chair 11 in its erect condition.

By pulling the legs 32, so that the links 34 slide out of the slots 47 until the ends of the slots 45 in the links engage the pins 46, it becomes possible to rotate the legs 32 relative to the arms 31. This is because top surfaces 50 of the links 34 no longer engage the surfaces 51 of the slots 47. In addition, the links 34 now extend a sufficient distance from the arms 31, so as to accommodate the widths of the rear legs 33.

In the preferred embodiment, the ends 41 of the legs 32 and the ends 48 of the arms 31 are at 45° with respect to the extent of the legs and arms, so that the ends abut one another along a plain which is at 45° with respect to the horizontal. With this particular configuration, the legs 32 extend normally with respect to the arms 31. If it is desired to have the legs 32 extend at, for example, an obtuse angle with the arms 31, then the ends may be cut at a different angle. In any event, the engagement between the ends 40 and 48 provides a rigid support for the chair 11, when combined with the interaction of the links 34 and slots 47 as described above.

As seen in the drawings, the front rung 14 extends between the front legs 32-32, the rear rung 16 extends between the legs 33-33 and the top rung 15 extends between projecting portions 60-60 of the rear legs 33-33. As best seen in FIGS. 4 and 5, the sections 17, 18 and 19 of the sling 12 are secured to the rungs 14, 15 and 16 by rods 63, 64 and 65 attached to the sections and received in grooves 66, 67 and 68 cut in the rungs. The rods 63 are preferably positioned in pockets 70 formed or sewn in the ends of the sections 17, 18 and 19. In order to provide for adjustment, several pockets 70 may be provided at the end of each section.

As seen in FIG. 5, the end of the sling section 17 is secured in the slot 66 by the rod 63, and then extended counterclockwise around the rung 14, so that it extends over the rod 63. The end of the sling section 19 is retained in the slot 68 by the rod 65 and extended around the rung 16 in the clockwise direction and over the rod 65. Finally, the end of the sling section 18 is held in the slot 67 by the rod 64 and extended around the rung 15 in the clockwise direction, so as to extend over the rod 64. When a person sits in the sling 12, the various sections 17, 18 and 19 are pulled taut and the portions of the sections overlying the rods 63, 64 and 65 hold the rods in their respective slots 66, 67 and 68.

Again, as seen in FIG. 5, when a person is sitting in the sling 12, he rests in the section 17 with his back against the section 18. This causes tension on the section 18, which tends to rotate the legs 33-33 in the clockwise direction into abutment with the ends 73 of the arms 31. The force is greater than the tensional force along the web section 19, so that the legs 33 will not tend to rotate in the counterclockwise direction about the pivots 36 and collapse. In order to insure safety, a positive retaining means, such as a hook 74 may be used to hold the legs 33 in engagement with the arms 31. The tensional force along section 17 of the sling 12 tends to hold the ends 41 and 48 of the front legs 32 and arms 31 in engagement, and also tends to hold the link 34 within the slot 47 in the afore-mentioned second position, so that the front legs 32 cannot pivot relative to the arms 31.

Figure 7:
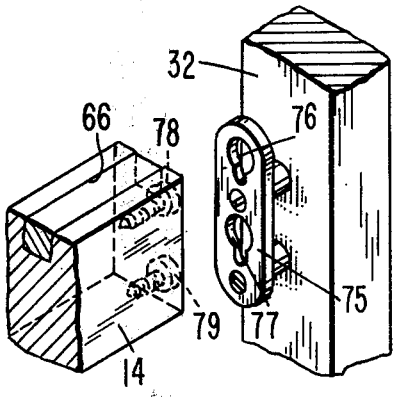
FIG. 7 is an isometric view of a bracket which detachably secures rungs of the chair to side frame members of the chair.

In order to provide additional convenience, the rungs 14, 15 and 16 are attached to the front legs 32 and rear legs 33, respectively, by brackets 75 (see FIG. 7) which allow the rungs to be readily detached. As shown in FIG. 7, each bracket 75 has a pair of keyhole slots 76 and 77 therein. Each rung has a pair of headed members, such as screws 78 and 79 which register with the keyhole slots 76 and 77, respectively. During assembly, the headed members 78 and 79 are slid into the wide portions of the slots 76 and 77, and then moved to the narrow portions of the slots, so that they will not slip out of the slots.

As seen in FIG. 6, when the seat 11 is folded, its center of gravity is located at point 80, which is between the points 81 and 82 of the arms 31 and legs 32 upon which the seat rests. Consequently, the chair 11 may be stored in a vertical position without falling over.

As seen, specifically, in FIG. 5, the rear legs 33 deviate from the vertical by an angle of about 12° in order to enhance the stability of the chair, when it is in its erect condition and not being sat in. The rear ends 73 of the arms 31 are also angled at 12°, so that the legs 33 will fit flushed there against.

While the instant invention has been illustrated by way of the foregoing drawings and embodiment, which are for the purpose of illustration only, the invention is limited only by the following appended claims.

What is claimed is:

1. A seat which is foldable to assume either an erect sitable condition or a collapsed storable condition, comprising:

A. A pair of frame members which define sides of the seat wherein each frame member comprises:

an arm having front and rear ends and extending generally in a horizontal direction when the seat is in the erect condition;

a rear leg having a certain width and pivoted adjacent to the rear end of the arm to extend therefrom when the seat is erect and to extend therealong when the seat is collapsed, said rear leg having a projecting portion extending above the arm when the seat is erect, said rear leg forming an acute angle with the top surface of the arm; and a front leg having a link fixed rigidly thereto and extending at an angle therefrom;

a sliding pivot connection between the link and the front end of the arm to pivot the link and the front leg adjacent to the front end of the arm, said link being longer than the width of said rear leg so that when the link and front leg are pivoted to collapse the seat, the front leg overlies the rear leg, wherein the sliding pivot connection allows the link and the front leg to pivot when the link is slid to a first position and prevents the front leg from pivoting when slid to a second position;

B. a system of rungs which combine with the pair of frame members to define a top, a front and a back of the seat, wherein one rung extends between the projecting portions of the rear legs, one rung extends between the rear legs of the frame below the arm and one rung extends between the front legs of the frame; and C. a web supported by the rungs to form a sling for seating a person, wherein said web applies torque to said rear leg in the direction of said front rung when the person sits in the web in order to help keep the rear leg erect when a person sits in the seat.

2. The seat of claim 1, wherein the rungs are movable relative to the frames to allow the frame members to collapse toward one another.

3. The seat of claim 2, wherein the rungs are detachable from the frame members to allow disassembly of the seat.

4. The seat of claim 1, wherein the web includes a first portion which extends between the rung connecting the rear legs below the arm and the rung connecting the front legs to form a sitting support and a second portion which extends between the first portion and the rung connecting the projecting portions of the rear legs to form a back support.

5. The seat of claim 4, wherein the second portion of the web is adjustable in length to adjust the sitting position of the seat.

6. The seat of claim 4, wherein the web is detachable from the rungs.

7. The seat of claim 6, wherein each rung includes a longitudinal slot extending in a surface thereof, and wherein the web has rods extending therein proximate the ends of the first and second portions, wherein the rods are received in the slots to detachably retain the web on the rungs.

8. The seat of claim 7, wherein the slots extend in top surfaces of the rungs and the ends of the first and second portions of the web are wrapped once around the rungs and over the slots with the rods therein to detachably retain the web on the rungs.

9. The seat of claim 1, wherein the link has a closed slot extending therein, and the arm has a fixed pin which is received within the slot to form the sliding pivot.

10. The seat of claim 9, wherein the link is received within a groove extending back into the arm, and wherein the pin extends across the groove, and is spaced from the end of the groove.

11. The seat of claim 10, wherein the top of the groove forms a shoulder which cooperates with the pin to prevent the link from rotating when the link is in the second position.

12. The seat of claim 1, wherein when the rear legs are pivoted to extend along the arm and the front leg is pivoted to extend over the rear leg, the first ends of the arms cooperate with adjacent ends of the front legs to form a support to retain the seat in the collapsed storable condition with the arms and legs extending substantially vertically.

13. The seat of claim 1 further including:

slots having rectangular cross-sections extending longitudinally in the top surface in each of said rungs, wherein said web has a first portion which extends between the front and rear rungs, and a second portion which extends between the first portion and the top rung, said portions having ends with rod retaining means therein; and rod means having a rectangular cross-section approximating the rectangular cross-section of the slots, wherein said means are held by each of said retaining means, said rod means being inserted laterally in said slot means to secure the web to the rungs.

14. The seat of claim 13, wherein the portions wrap around the rungs once prior to insertion of the rods in the slots.

15. The seat of claim 14, wherein the portions overlie the slots and rods when the web is mounted on the rungs;

16. The seat of claim 15, wherein the side frames fold.

* * * * *